US010944197B2

(12) United States Patent
Otsu et al.

(10) Patent No.: US 10,944,197 B2
(45) Date of Patent: Mar. 9, 2021

(54) CONNECTOR TERMINAL AND CONNECTOR

(71) Applicant: OMRON Corporation, Kyoto (JP)

(72) Inventors: Norihiro Otsu, Okayama (JP); Tomoyuki Haruna, Okayama (JP); Hidekazu Koyama, Okayama (JP); Yukito Yoshida, Okayama (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 16/645,775

(22) PCT Filed: Nov. 2, 2018

(86) PCT No.: PCT/JP2018/040864
§ 371 (c)(1),
(2) Date: Mar. 9, 2020

(87) PCT Pub. No.: WO2019/102824
PCT Pub. Date: May 31, 2019

(65) Prior Publication Data

US 2020/0280147 A1 Sep. 3, 2020

(30) Foreign Application Priority Data

Nov. 22, 2017 (JP) ..... JP2017-225147

(51) Int. Cl.
*H01R 13/41* (2006.01)
*H01R 4/18* (2006.01)

(52) U.S. Cl.
CPC ..... *H01R 13/41* (2013.01); *H01R 4/185* (2013.01)

(58) Field of Classification Search
CPC ..... H01R 4/185; H01R 13/41
(Continued)

(56) References Cited

U.S. PATENT DOCUMENTS 3,462,726 A * 8/1969 Roydon ..... H01R 13/432 439/252
3,980,385 A * 9/1976 Hirokawa ..... H01R 13/432 439/748

(Continued)

FOREIGN PATENT DOCUMENTS

DE 202016102938 U1 9/2017
EP 1460725 A1 9/2004

(Continued)

OTHER PUBLICATIONS

International Search Report; International Application No. PCT/JP2018/040864; Internatiuonal Filing Date Nov. 2, 2018; dated Feb. 5, 2019; 4 pages.

(Continued)

*Primary Examiner* — Abdullah A Riyami
*Assistant Examiner* — Marcus E Harcm
(74) *Attorney, Agent, or Firm* — Cantor Colburn LLP

(57) ABSTRACT

A connector terminal may include a terminal body extending along a center line, a contact portion provided at a first end portion of the terminal body in an extension direction of the terminal body, and a lance portion provided at a second end portion of the terminal body in the extension direction of the terminal body. The lance portion includes at least three positioning lances, when viewed from the extension direction of the center line, an angle formed by a first imaginary straight line connecting the center line and the first positioning lance and a second imaginary straight line connecting the center line and the second positioning lance is larger than 0 degrees and smaller than 180 degrees around the center line, and an angle formed by the first imaginary straight line and a third imaginary straight line connecting the center line and the third positioning lance is larger than
(Continued)

0 degrees and smaller than 180 degrees around the center line.

10 Claims, 9 Drawing Sheets

(58) Field of Classification Search
USPC ..... 439/736, 851, 852, 861, 877, 842
See application file for complete search history.

(56) References Cited

U.S. PATENT DOCUMENTS 4,031,614 A * 6/1977 Gipe ..... H01R 43/16 29/879
4,707,050 A 11/1987 Konnemann
5,437,567 A * 8/1995 Peterson ..... H01R 13/113 439/851
5,667,413 A * 9/1997 Trafton ..... H01R 13/187 439/271
5,681,190 A * 10/1997 Childs ..... H01R 13/11 439/842
5,913,695 A * 6/1999 Okabe ..... H01R 4/2466 439/397
6,217,379 B1 * 4/2001 D'Hulster ..... H01R 13/04 439/752.5
7,347,747 B2 * 3/2008 Shimizu ..... H01R 13/11 439/842
9,281,575 B2 * 3/2016 Matsumura ..... H01R 13/422
10,355,395 B2 * 7/2019 Hashimoto ..... H01R 11/11
2001/0051464 A1 12/2001 Kodama
2002/0025696 A1 * 2/2002 Irikura ..... H01R 13/04 439/66
2003/0190842 A1 * 10/2003 Fukatsu ..... H01R 13/4362 439/595
2008/0146090 A1 * 6/2008 Shimizu ..... H01R 13/4223 439/842
2009/0191769 A1 * 7/2009 Diemer ..... H01R 13/432 439/869
2010/0255734 A1 * 10/2010 Nakata ..... H01R 13/5205 439/877
2010/0267280 A1 * 10/2010 Tamagawa ..... H01R 4/185 439/587
2011/0021078 A1 * 1/2011 Iida ..... H01R 12/721 439/630
2011/0136397 A1 * 6/2011 Koga ..... H01R 4/185 439/877
2011/0207374 A1 * 8/2011 Tsuji ..... H01R 13/04 439/884
2011/0250804 A1 * 10/2011 Nishide ..... H01R 13/4223 439/888
2014/0220835 A1 * 8/2014 Seipel ..... H01R 4/185 439/877
2015/0380863 A1 * 12/2015 Uchida ..... H01R 13/5205 439/587
2016/0104948 A1 * 4/2016 Droesbeke ..... H01R 4/18 439/880
2016/0172782 A1 * 6/2016 Endo ..... H01R 13/428 439/746
2016/0261054 A1 * 9/2016 Sato ..... H01R 4/185
2016/0268718 A1 * 9/2016 Nagasaki ..... H01R 13/113
2016/0294096 A1 * 10/2016 Uchida ..... H01R 13/42
2016/0336669 A1 * 11/2016 Li ..... H01R 13/114
2016/0344129 A1 * 11/2016 Jakoplic ..... H01R 13/428
2019/0044270 A1 * 2/2019 Miyamura ..... H01R 13/4362
2019/0089080 A1 * 3/2019 Hayashi ..... H01R 13/631
2019/0363487 A1 * 11/2019 Metzler ..... H01R 4/185
2020/0021054 A1 * 1/2020 Maesoba ..... H01R 4/185

FOREIGN PATENT DOCUMENTS

JP 5758281 4/1982
JP 58195981 12/1983
JP S59146173 A 8/1984
JP H5343123 A 12/1993
JP H855649 A 2/1996
JP H8185918 A 7/1996
JP 2000208196 A 7/2000
TW M480183 U 6/2014

OTHER PUBLICATIONS

TW Office Action corresponding to TW107139754; dated Oct. 9, 2019 with English Translation; 13 pages.
Written Opinion of the International Searching Authority; International Application No. PCT/JP2018/040864; Internatiuonal Filing Date Nov. 2, 2018; dated Feb. 5, 2019; 8 pages.

* cited by examiner

CONNECTOR TERMINAL AND CONNECTOR

CROSS REFERENCE TO RELATED APPLICATIONS

This is the U.S. national stage of application No. PCT/JP2018/040864, filed on Nov. 2, 2018. Priority under 35 U.S.C. § 119(a) and 35 U.S.C. § 365(b) is claimed from Japanese Application No. 2017-225147 filed Nov. 22, 2017, the disclosure of which is also incorporated herein by reference.

TECHNICAL FIELD

The present disclosure relates to a connector terminal and a connector including the connector terminal.

BACKGROUND ART

PTL 1 discloses a contact pin of a connector formed by punching and bending a metal plate into a predetermined shape. This contact pin extends linearly and includes a pin-shaped contact terminal portion provided on a front end side, a body portion provided in a middle, and a connection terminal portion provided on a rear end side.

In the contact pin, a pair of lances protruding to left and right are provided on the body portion at intervals of 180 degrees around a center line extending in an extension direction of the contact pin. In addition, each of the lances is locked to a corresponding one of a pair of hollow locking portions formed on an inner peripheral surface serving as a contact holding hole of an insulator to be held in the contact holding hole of the insulator.

CITATION LIST

Patent Literature

PTL 1: JP H08-055649 A

SUMMARY OF INVENTION

Technical Problem

Only when the contact pin is inserted into the contact holding hole in a predetermined orientation around an axis, each of the lances is locked to a corresponding one of the hollow locking portions. This may cause, depending on the orientation of the contact pin when the contact pin is inserted into the contact holding hole, the contact pin to fail to be held in the contact holding hole and to fall off from the insulator.

It is an object of the present disclosure to provide a connector terminal that can reduce falling off from a housing, and a connector including the connector terminal.

Solution to Problem

A connector terminal as an example of the present disclosure that can be held in a holding portion of a connector having a housing that can be held in a holding portion of a connector having a housing, which has insulation properties and in which the holding portion is provided, and that can connect an electric wire, the connector terminal comprising:

a terminal body extending along a center line;

a contact portion provided at a first end portion of the terminal body in an extension direction of the terminal body;

a lance portion provided at a second end portion of the terminal body in the extension direction of the terminal body; and a connection portion that is disposed between the contact portion and the lance portion and that can connect a conductor portion of the electric wire from the lance portion side, wherein the lance portion includes at least three positioning lances, which are provided at intervals around the center line, that can be locked to a locking portion of the housing in an extension direction of the center line, and that position the connector terminal in the holding portion in the extension direction of the center line, the at least three positioning lances include a first positioning lance, a second positioning lance and a third positioning lance, the second positioning lance and the third positioning lance being arranged on both sides of the first positioning lance in a circumferential direction with respect to the center line, and when viewed from the extension direction of the center line, an angle formed by a first imaginary straight line connecting the center line and the first positioning lance and a second imaginary straight line connecting the center line and the second positioning lance is larger than 0 degrees and smaller than 180 degrees around the center line, and an angle formed by the first imaginary straight line and a third imaginary straight line connecting the center line and the third positioning lance is larger than 0 degrees and smaller than 180 degrees around the center line.

A connector as an example of the present disclosure includes:

the connector terminal; and the housing including the holding portion in which the connector terminal is held.

Advantageous Effects of Invention

According to the connector terminal, the lance portion is provided at the second end portion in the extension direction of the terminal body, so that when the connector terminal is held in the holding portion of the housing, the lance portion is lastly held in the holding portion. This makes it possible to realize the connector terminal that is easily held in the holding portion of the housing and allows confirmation of whether each of the positioning lances is locked to the locking portion of the housing to be easily made as compared with the contact pin having a pair of lances provided on a body portion provided in a middle of the contact pin disclosed in PTL 1.

The connector terminal includes at least three positioning lances, that is, the first positioning lance, the second positioning lance, and the third positioning lance, that position the connector terminal in the holding portion of the connector terminal in the extension direction of the center line. When viewed from the extension direction of the center line, the angle formed by the first imaginary straight line connecting the center line and the first positioning lance and the second imaginary straight line connecting the center line and the second positioning lance is larger than 0 degrees and smaller than 180 degrees around the center line of the terminal body, and the angle formed by the first imaginary straight line and the third imaginary straight line connecting the center line and the third positioning lance is larger than 0 degrees and smaller than 180 degrees around the center line of the terminal body. This allows, as compared with the contact pin having a pair of lances arranged at intervals of 180 degrees or more around the center line disclosed in PTL 1, the connector terminal to be easily locked to the locking portion of the housing regardless of the orientation of the connector terminal around the center line when the connector terminal is held in the holding portion. This in turn makes it possible to realize the connector terminal that can reduce falling off of the connector terminal from the housing.

Since the connector includes the connector terminal, it is possible to realize the connector that can prevent the connector terminal from falling off from the housing and that is easily assembled.

DESCRIPTION OF EMBODIMENTS

Hereinafter, a description will be given of an example of the present disclosure with reference to the accompanying drawings. Note that, in the following description, terms representing specific directions or positions (for example, terms including "up", "down", "right", and "left") will be used as necessary, but the use of these terms is intended to facilitate understanding of the present disclosure with reference to the drawings, and the technical scope of the present disclosure is not limited by the meanings of the terms. Further, the following description shows merely an example in nature and is not intended to limit the present disclosure, applications of the present disclosure, or uses of the present disclosure. Furthermore, the drawings are schematic drawings, and ratios between dimensions are not necessarily equal to the actual ratios.

Figure 1:
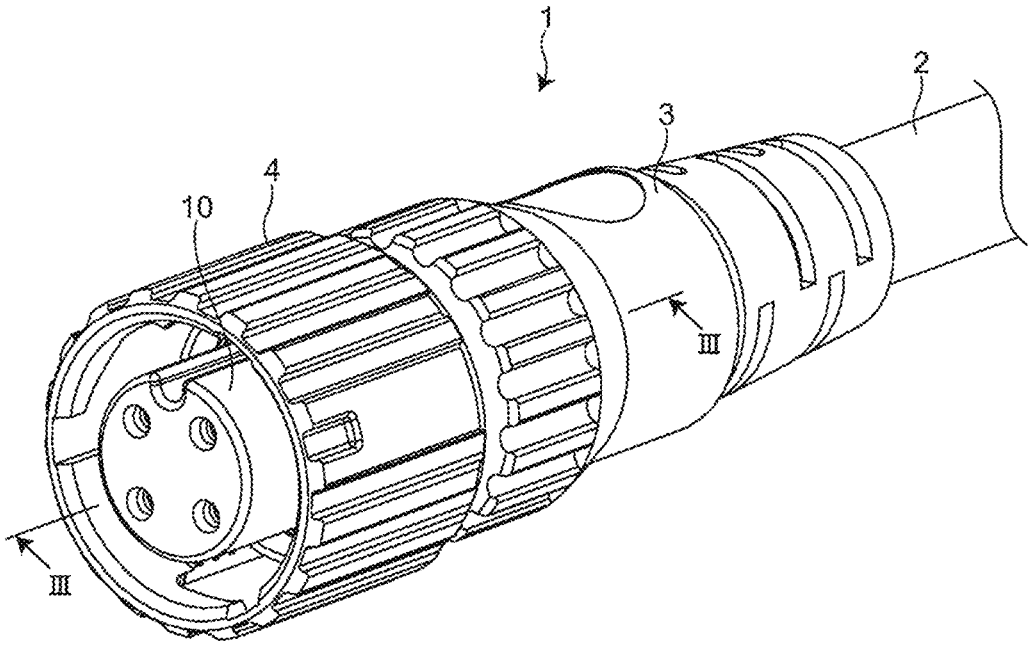
FIG. 1 is a perspective view of a connector according to an embodiment of the present disclosure.

As shown in FIG. 1, a connector 1 according to an embodiment of the present disclosure is a socket connector to which a plug connector (not shown) can be connected, and includes an insulating housing 10 having a holding portion 11. Note that, according to this embodiment, as an example, the housing 10 has four holding portions 11, and each of the holding portions 11 has an approximately columnar shape.

Figure 2:
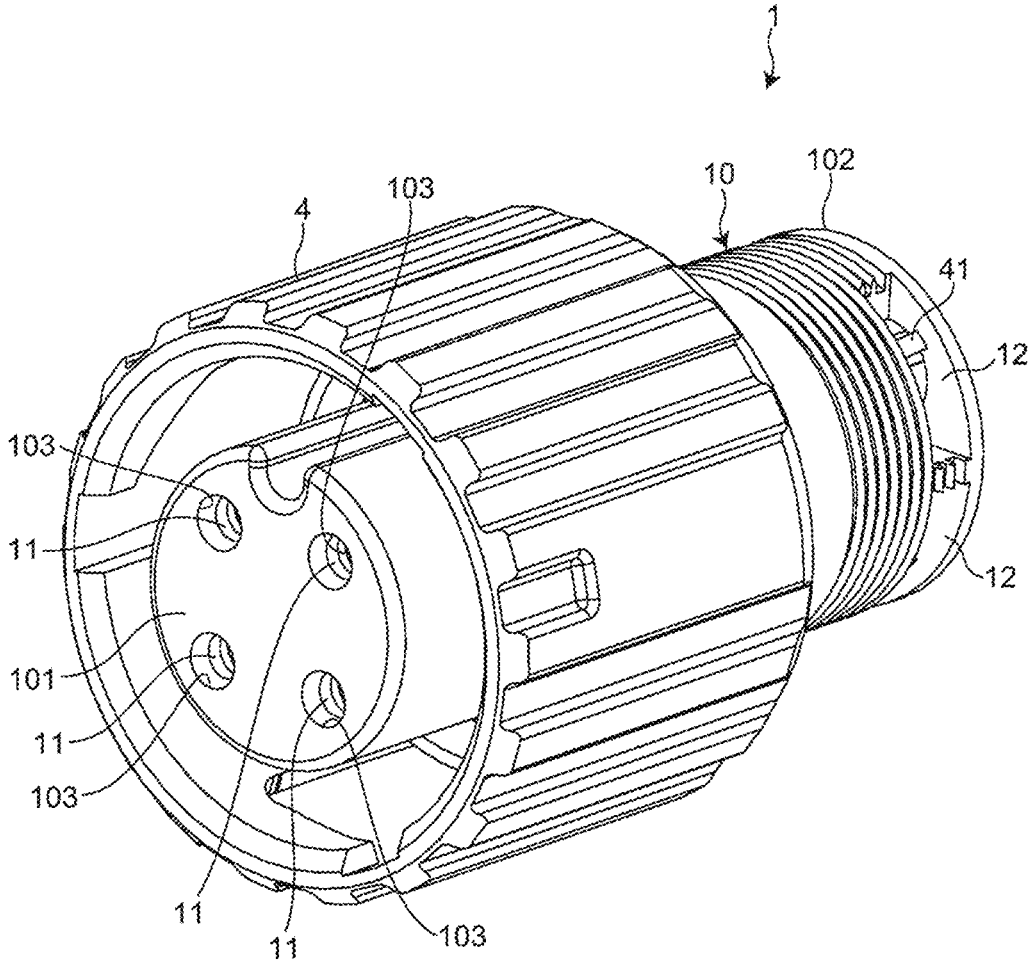
FIG. 2 is a perspective view showing the connector shown in FIG. 1 with an electric wire and a cover removed from the connector.

As shown in FIG. 2, the housing 10, which has an approximately cylinder shape, includes a terminal insertion surface provided on an outer end portion 101 of the housing 10 in an extension direction of the housing 10. Provided on the terminal insertion surface are four opening portions 103 with each of which a corresponding one of the holding portions 11 communicates. Further, provided at an inner end portion 102 in the extension direction of the housing 10 is a locking portion 12 to which a lance portion 40 of a connector terminal 20 to be described later can be locked in an extension direction of the holding portions 11. According to this embodiment, as an example, the locking portion 12 includes four cutout portions 12 each associated with a corresponding one of the holding portions 11 (only two cutout portions 12 are shown in FIG. 2). Each of the cutout portions 12 extends in a circumferential direction of the housing 10 and has a length of about one sixth of an outer peripheral length of the housing 10.

Figure 3:
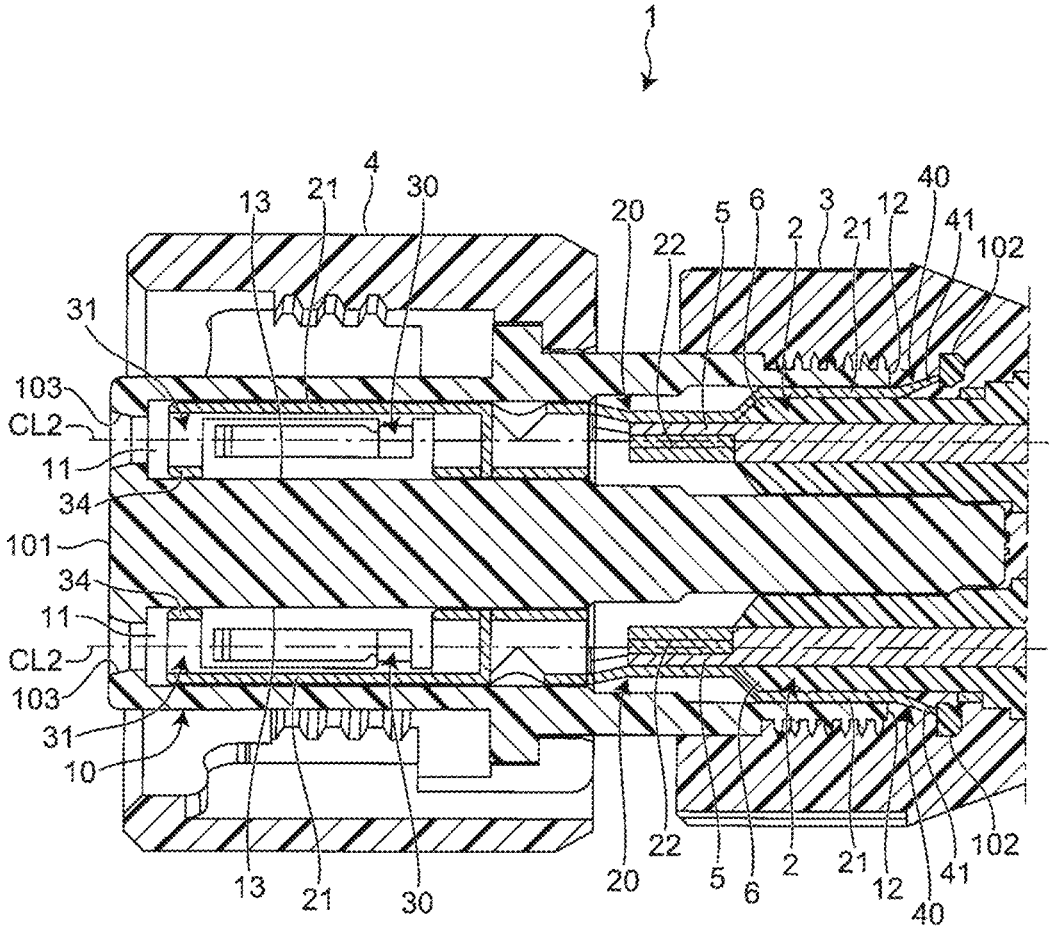
FIG. 3 is a cross-sectional view taken along a line of FIG. 1.
Figure 4:
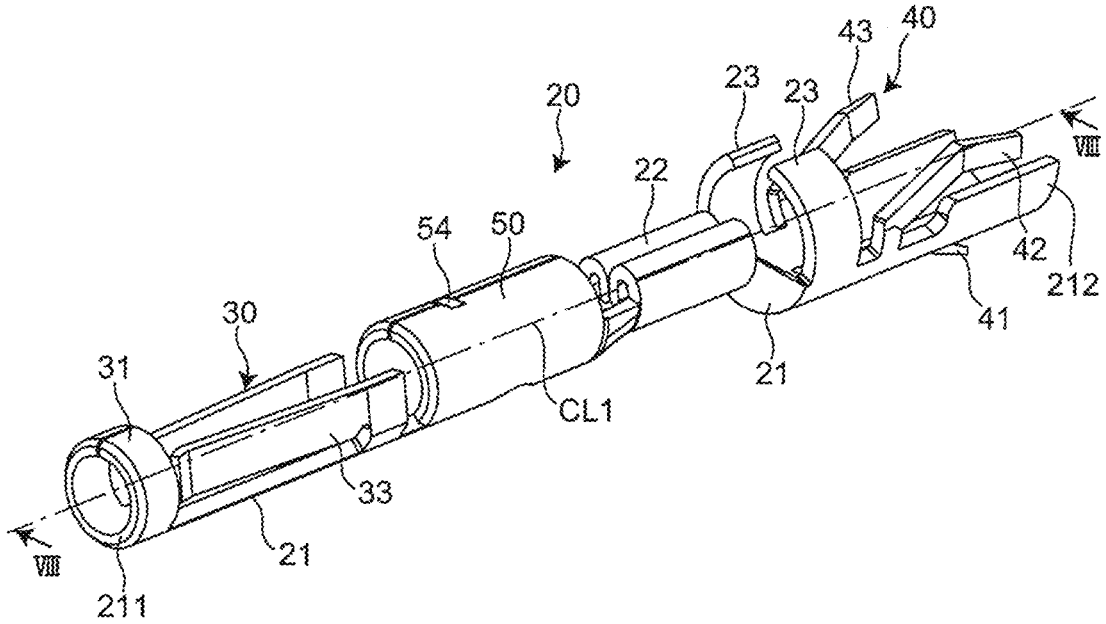
FIG. 4 is a perspective view of a socket terminal that is a connector terminal according to the embodiment of the present disclosure.

As shown in FIG. 3, in each of the holding portions 11, the connector terminal 20 shown in FIG. 4 is held (only two holding portions 11 are shown in FIG. 3). A conductor portion 5 of an electric wire 2 is connected to the connector terminal 20 from the inner end portion 102 (shown in FIG. 2) side in the extension direction of the housing 10.

As shown in FIGS. 1 and 3, provided at the inner end portion 102 of the housing 10 is, as an example, a cover portion 3 molded of a polybutylene terephthalate resin (PBT resin). The cover portion 3 is formed to cover the inner end portion 102 of the housing 10 and the electric wire 2. As shown in FIGS. 1 to 3, provided around the extension direction of the housing 10 is a fixing portion 4 that is used to fix a connected plug connector.

Note that, in FIG. 2, the electric wire 2 and the cover portion 3 are removed.

Next, a description will be given of the connector terminal 20 according to the embodiment of the present disclosure with reference to FIGS. 4 to 12. According to this embodiment, the connector terminal 20 is, as an example, a socket terminal to which a plug terminal 120 (see FIG. 12) can be connected.

As shown in FIG. 4, the socket terminal 20 includes a terminal body 21 extending along a center line CL1 of the socket terminal 20, a contact portion 30 provided at a first end portion 211 serving as one end portion in an extension direction of the terminal body 21, the lance portion 40 provided at a second end portion 212 serving as the other end portion in the extension direction of the terminal body 21, and a connection portion 22 disposed between the contact portion 30 and the lance portion 40. Provided between the connection portion 22 and the contact portion 30 of the terminal body 21 is a resin positioning portion 50. Note that the center line CL1 of the socket terminal 20 extends approximately parallel to a center line CL2 (shown in FIG. 3) of the holding portion 11 of the housing 10. The connection portion 22 is provided to allow the conductor portion 5 of the electric wire 2 to be connected to the connection portion 22 from the lance portion 40.

As shown in FIG. 4, the terminal body 21 has a pair of electric wire clamp portions 23 provided between the connection portion 22 and the second end portion 212 of the terminal body 21. Each of the electric wire clamp portions 23 extends around the center line CL1 from both end portions of the socket terminal 20 in a width direction intersecting the extension direction of the center line CL1 and clamps an insulation portion 6 (shown in FIG. 3) of the electric wire 2 when the conductor portion 5 of the electric wire 2 is connected to the connection portion 22.

Figure 5:
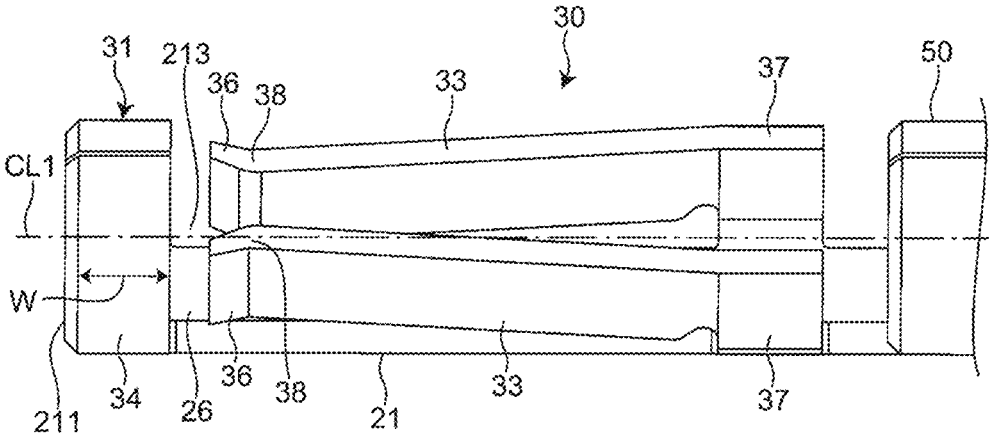
FIG. 5 is a perspective view showing a contact portion of the socket terminal shown in FIG. 4.

As shown in FIG. 5, the terminal body 21 has a plug terminal holding portion 213 capable of holding the plug terminal 120 between a position restriction portion 31 at the first end portion 211 and the resin positioning portion 50, and a terminal guide surface 26 provided on the plug terminal holding portion 213. The terminal guide surface 26 guides the plug terminal 120 in the extension direction of the center line CL1 when the socket terminal 20 is inserted into the holding portion 11 of the housing 10.

Figure 6:
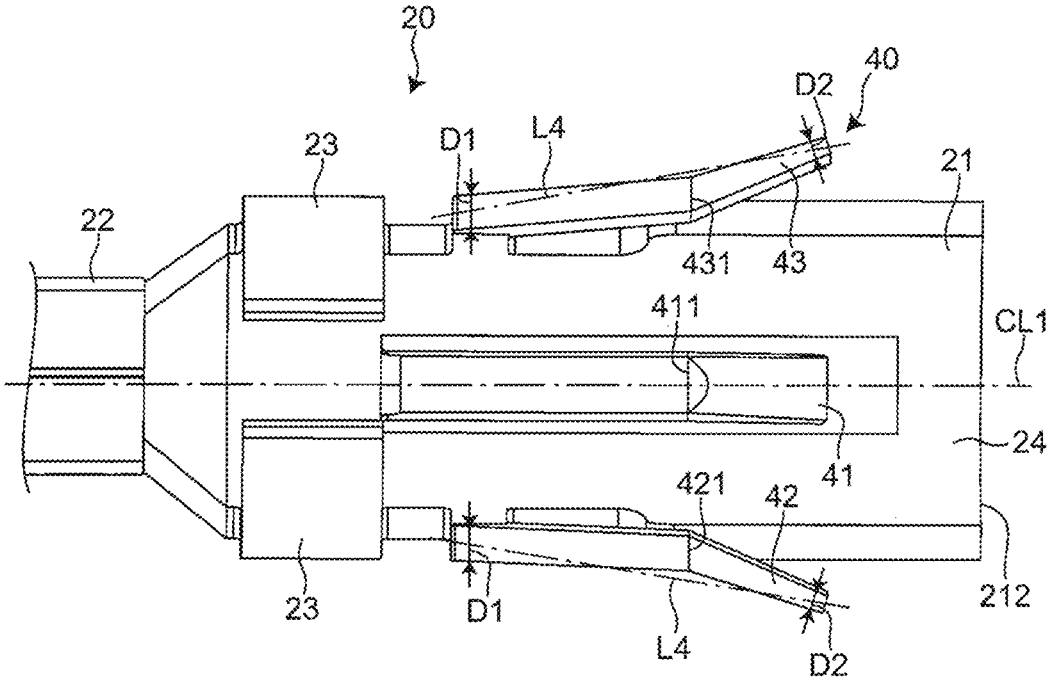
FIG. 6 is a plan view showing a lance portion of the socket terminal shown in FIG. 4.
Figure 7:
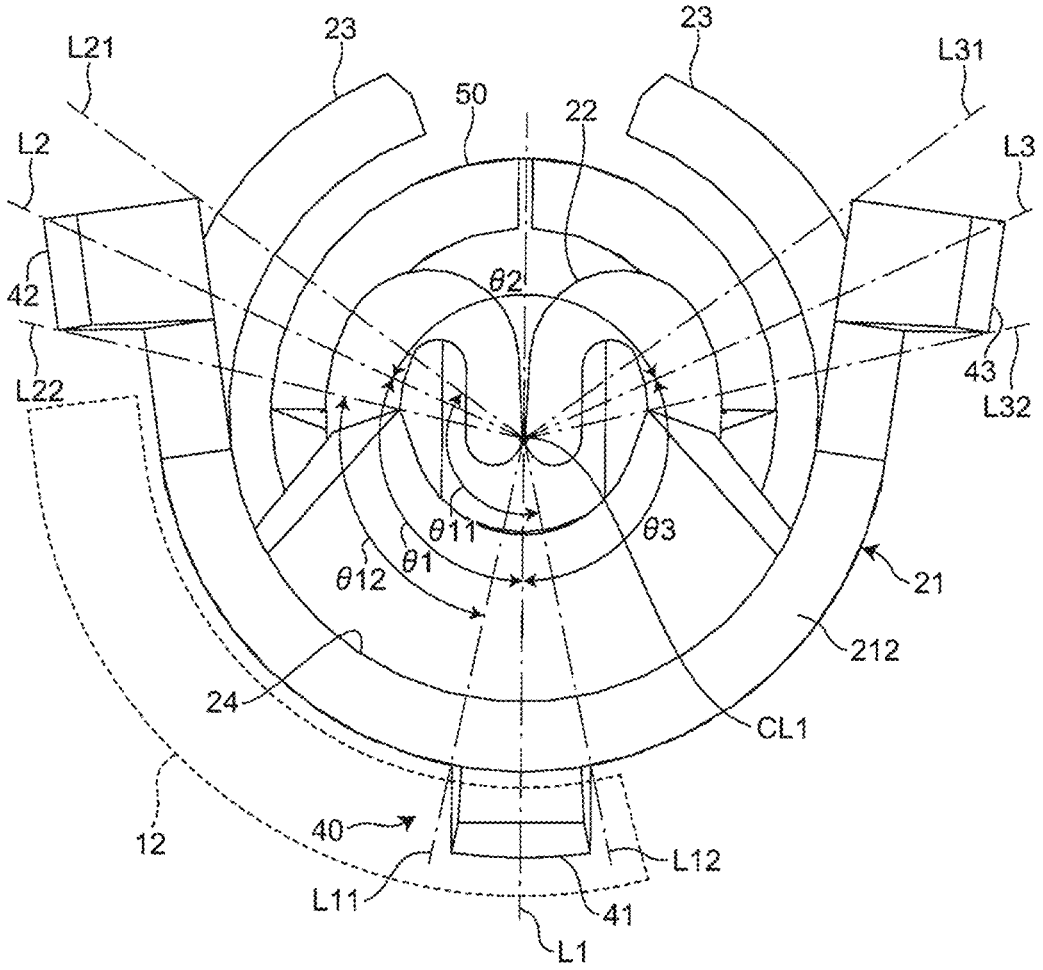
FIG. 7 is a plan view of the lance portion side of the socket terminal shown in FIG. 4 when viewed from an extension direction of a center line of the socket terminal.

As shown in FIG. 6, the terminal body 21 has an electric wire guide surface 24 provided on the second end portion 212. As shown in FIG. 7, the electric wire guide surface 24 is an approximately semicircular arc surface around the center line CL1 when viewed from the extension direction of the center line CL1 and guides the electric wire 2 in the extension direction of the center line CL1 when the conductor portion 5 of the electric wire 2 is connected to the connection portion 22.

As shown in FIG. 4, the contact portion 30 has the position restriction portion 31 provided at a tip of the terminal body 21 adjacent to the first end portion 211 and a resilient contact portion 33 provided between the position restriction portion 31 and the connection portion 22 of the terminal body 21. The contact portion 30 is disposed so as to come into contact with the plug terminal 120 inserted into the holding portion 11 through the opening portion 103 opening to an opening surface of the outer end portion 101 of the housing 10.

As shown in FIG. 3, the position restriction portion 31 is configured by an annular band portion 34. The annular band portion 34 is provided at an end portion of the contact portion 30 away from the connection portion 22, and, as shown in FIG. 5, extending, in a circumferential direction, on an inner peripheral surface 13 of the housing 10 serving as the holding portion 11. The annular band portion 34 has an approximately uniform width W (that is, a length of the socket terminal 20 in the extension direction of the center line CL1). The annular band portion 34 is provided so as to restrict by its outer peripheral surface the position of the contact portion 30 in a direction orthogonal to the extension direction of the holding portion 11 when the socket terminal 20 is held in the holding portion 11 and so as to insert the plug terminal 120 into the annular band portion 34.

Specifically, the position restriction portion 31 is configured to restrict the position through contact between the outer peripheral surface of the annular band portion 34 and the inner peripheral surface 13 of the housing 10 when the socket terminal 20 is held in the holding portion 11.

As shown in FIG. 5, the resilient contact portion 33 is provided as a pair at one end portion and the other end portion (that is, both end portions) of the terminal guide surface 26 of the terminal body 21 in the width direction intersecting the extension direction of the center line CL1. The resilient contact portions 33 each have a flat plate shape and are arranged symmetrically with respect to the center line CL1. The resilient contact portions 33 each extend from both ends in the width direction of the terminal body 21 toward the position restriction portion 31 along the center line CL1 and toward a center portion of the terminal body 21 in the width direction. Each of the resilient contact portions 33 is provided so as to come into contact with the plug terminal 120 inserted into the holding portion 11 of the housing 10 to resiliently deform in the width direction and away from the center line CL1.

That is, each of the resilient contact portions 33 has a cantilever structure, and a proximal end portion 37 that is one end portion of the resilient contact portion 33 in the extension direction of the resilient contact portion 33, is connected to the terminal body 21. Each of the resilient contact portions 33 has a distal end portion 36 that is not connected to the terminal body 21, is located adjacent to the center line CL1 as compared with the proximal end portion 37 connected to the terminal body 21 in the width direction of the terminal body 21, and is swingable in the width direction of the terminal body 21.

A bent portion 38 that is bent away from the center line CL1 in the width direction of the terminal body 21 is provided at the distal end portion 36 of each of the resilient contact portions 33 adjacent to the position restriction portion 31. The bent portion 38 allows the plug terminal 120 inserted through the annular band portion 34 of the position restriction portion 31 to be smoothly inserted between the pair of resilient contact portions 33 without collision with the distal end portions 36 of the pair of resilient contact portions 33 when the plug terminal 120 is inserted into the holding portion 11.

As shown in FIG. 6, the lance portion 40 has at least three positioning lances that position the connector terminal 20 (that is, the socket terminal 20) in the holding portion 11 in the extension direction of the center line CL1 (in this embodiment, three positioning lances, that is, a first positioning lance 41, a second positioning lance 42, and a third positioning lance 43). The positioning lances 41, 42 and 43 are provided at intervals around the center line CL1 so as to be locked to the locking portion 12 (that is, the cutout portions 12) of the housing 10 in the extension direction of the center line CL1 (see FIG. 3).

As shown in FIG. 6, the first positioning lance 41 is provided on the electric wire guide surface 24 of the second end portion 212 of the terminal body 21. Further, the second positioning lance 42 and the third positioning lance 43 are arranged on both sides of the first positioning lance 41 in the circumferential direction with respect to the center line CL1.

As shown in FIG. 6, an end portion adjacent to the connection portion 22 of each of the positioning lances 41, 42 and 43 is connected to the terminal body 21. Each of the positioning lances 41, 42 and 43 has a plate shape that extends and tapers from the end portion connected to the terminal body 21 in the extension direction of the center line CL1 toward the second end portion 212 of the terminal body 21. Each positioning lance 41, 42 and 43 extends gradually away from the center line CL1 toward the second end portion 212 of the terminal body 21 from the end portion connected to the terminal body 21. Each positioning lance 41 has a corresponding one of a bent portions 411, 421 and 431 located in an intermediate portion and closer to the center line CL1 than an imaginary straight line L4 connecting both end portions in the extension direction of each of the positioning lances 41, 42 and 43 (in FIG. 6, only the imaginary straight lines L4 of the second positioning lance 42 and the third positioning lance 43 are shown).

Note that, according to this embodiment, a straight line connecting centers in a thickness direction (denoted as D1 and D2 in FIG. 6) at both ends in the extension direction of each of the positioning lances 41, 42 and 43 is defined as the imaginary straight line L4.

As shown in FIG. 7, when viewed from the extension direction of the center line CL1, each of the positioning lances 41, 42 and 43 is configured such that an angle θ1 formed by a first imaginary straight line L1 connecting the center line CL1 and the first positioning lance 41 and a second imaginary straight line L2 connecting the center line CL1 and the second positioning lance 42 is larger than 0 degrees and smaller than 180 degrees around the center line CL1, and an angle θ3 formed by the first imaginary straight line L1 and a third imaginary straight line L3 connecting the center line CL1 and the third positioning lance 43 is larger than 0 degrees and smaller than 180 degrees around the center line CL1. Note that an angle formed by the second imaginary straight line L2 and the third imaginary straight line L3 is denoted as θ2.

Specifically, the positioning lances 41, 42 and 43 are arranged at equal intervals in the circumferential direction on a circumference of a circle centered on the center line CL1 when viewed from the extension direction of the center line CL1 (that is, θ1=θ2=θ3=120 degrees). Therefore, regardless of the orientation of the socket terminal 20 around the center line CL1 when the socket terminal 20 is held in the holding portion 11, the socket terminal 20 can be locked to the cutout portions 12 of the housing 10.

Note that the first imaginary straight line L1, the second imaginary straight line L2, and the third imaginary straight line L3 are each a straight line passing through the center line CL1 and any portion of a corresponding one of the positioning lances 41, 42 and 43 when viewed from the extension direction of the center line CL1. That is, as shown in FIG. 7, the first imaginary straight line L1 is any straight line in a range of from a straight line L11 to a straight line L12, and the second imaginary straight line L2 is any straight line in a range of from a straight line L21 to a straight line L22, and the third imaginary straight line L3 is any straight line in a range of from a straight line L31 to a straight line L32. Therefore, for example, the angle θ1 formed by the first imaginary straight line L1 and the second imaginary straight line L2 is any angle in a range of from an angle θ11 to an angle θ12.

Figure 8:
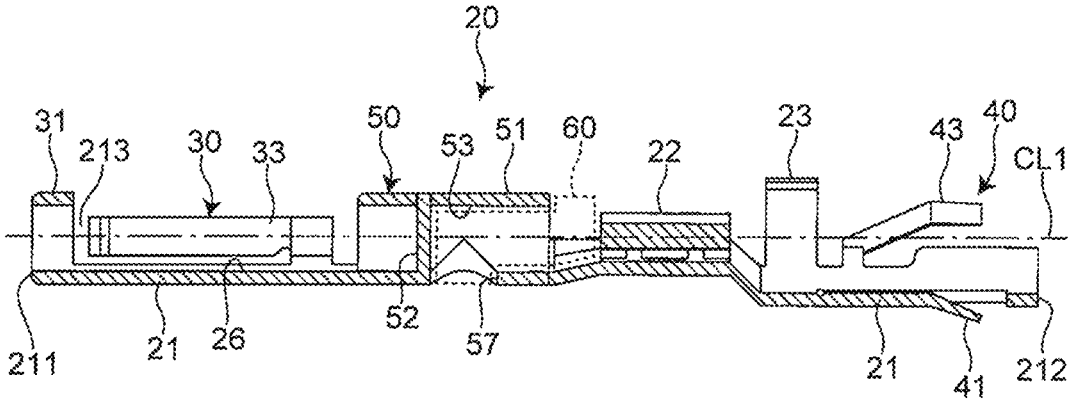
FIG. 8 is a cross-sectional view taken along a line VIII-VIII of FIG. 4.

As shown in FIG. 8, the resin positioning portion 50 has a guide wall portion 51 with a tubular shape having a through hole 53 with an approximately columnar shape extending along the center line CL1, and a positioning wall portion 52 formed by cutting and raising a part of the terminal body 21. The positioning wall portion 52 with an approximately disk shape is configured to close the through hole 53 inside the guide wall portion 51 in the extension direction of the center line CL1.

Figure 9:
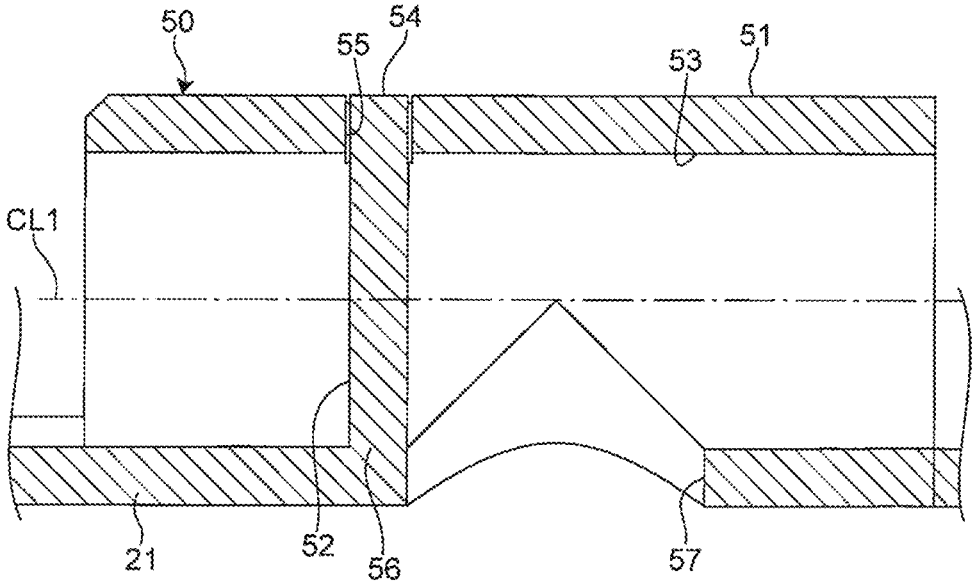
FIG. 9 is an enlarged view of a resin positioning portion 50 and the vicinity of the resin positioning portion 50 shown in the cross-sectional view of FIG. 8.

As shown in FIG. 9, the positioning wall portion 52 has a locking protrusion portion 54 protruding from the positioning wall portion 52 toward the outside of the resin positioning portion 50 in a direction intersecting the extension direction of the center line CL1. This positioning wall portion 52 is cut and raised from a side adjacent to the lance portion 40 toward the contact portion 30. The locking protrusion portion 54 and an uncut portion 56 that is an uncut portion of the positioning wall portion 52 are arranged at opposite ends of the positioning wall portion 52 in a radial direction with respect to a center of the disk shape. The guide wall portion 51 has a locking recess portion 55 that locks the locking protrusion portion 54 and restricts the position of the positioning wall portion 52 relative to the guide wall portion 51.

When the cover portion 3 is formed, resin that is the material of the cover portion 3 may flow into the resin positioning portion 50 from a side adjacent to the lance portion 40 toward the contact portion 30 to form a resin-filled portion 60 extending from the lance portion toward the contact portion 30. The guide wall portion 51 is configured to guide the resin flowing from the side adjacent to the lance portion 40 toward the contact portion 30 to the positioning wall portion 52, and the positioning wall portion 52 is configured to position the resin-filled portion 60.

As shown in FIG. 9, cutting and raising a part of the terminal body 21 to form the positioning wall portion 52 makes the resin less prone to flow into the plug terminal holding portion 213 of the terminal body 21 adjacent to the contact portion 30 even if the resin flowing into the resin positioning portion 50 flows out of the through hole 57 that is formed in the terminal body 21 when the positioning wall portion 52 is cut and raised and extends through the terminal body 21 in a direction orthogonal to the center line CL1.

A description will be given below of a process of forming the resin positioning portion 50 with reference to FIG. 10.

Figure 10:
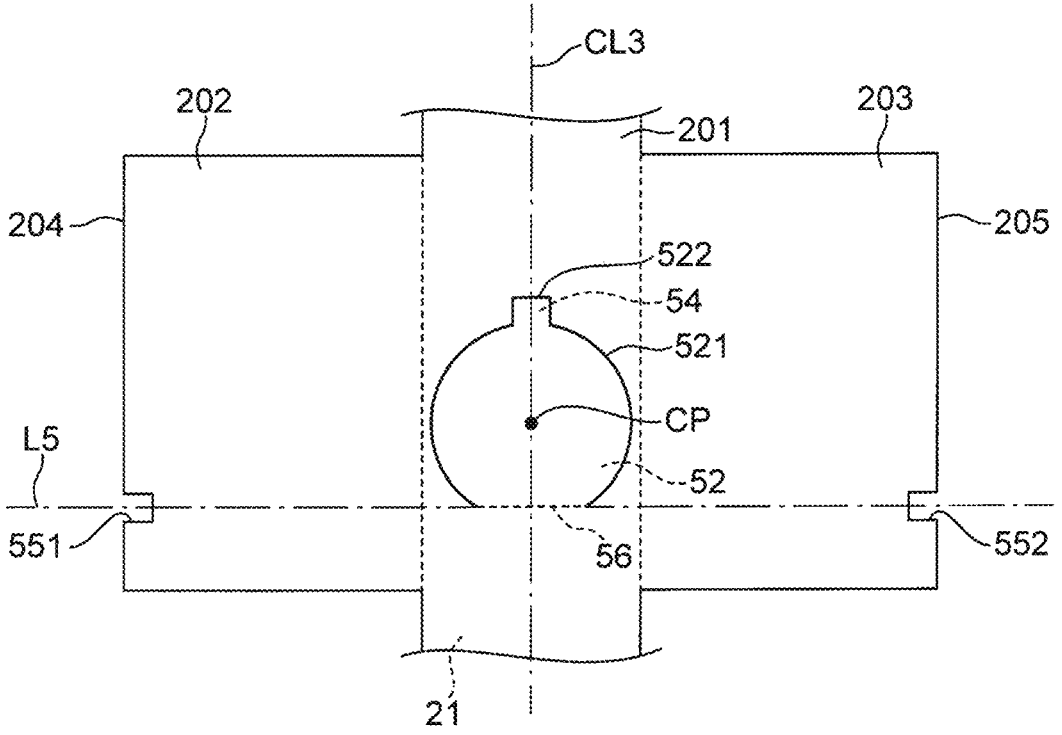
FIG. 10 is a plan view for describing a process of forming the resin positioning portion of the socket terminal shown in FIG. 4.

As shown in FIG. 10, the resin positioning portion 50 includes a second member 202 and a third member 203 each having an approximately rectangular plate shape. The second member 202 and the third member 203 are arranged on both sides in a short-side direction of a first member 201 that constitutes the terminal body 21 and has an approximately rectangular plate shape.

First, a cut is made around a center point CP located on a center line CL3 in the short-side direction of the first member 201 to form a slit 521 having an approximately arc shape, while recesses 551, 552 are formed, extending toward the center line CL3 of the first member 201, on outer side surfaces 204, 205 of the second member 202 and the third member 203 away from the center line CL3 of the first member 201, respectively.

The slit 521 is provided with a projecting portion 522 that projects in a direction away from the center point CP along the center line CL3. A part of the first member 201 surrounded by the projecting portion 522 constitutes the locking protrusion portion 54. On the opposite side of the projecting portion 522 in the radial direction with respect to the center point CP, no slit 521 is formed. The opposite side of the projecting portion 522 constitutes the uncut portion 56 of the positioning wall portion 52. Each of the recess portions 551, 552 is provided on an imaginary straight line L5 connecting both ends of the slit 521, and the two recess portions 551, 552 constitutes one locking recess portion 55.

Subsequently, a part of the first member 201 surrounded by the slit 521 is bent and raised approximately perpendicular to a plate surface of the first member 201 to form the positioning wall portion 52, while the second member 202 and the third member 203 are bent and raised along an outer peripheral surface around the center point CP of the positioning wall portion 52 to be joined to each other in a state that the outer surfaces 204, 205 face each other, thereby forming the guide wall portion 51.

At this time, the recess portions 551, 552 are connected with their openings facing each other to form the locking recess portion 55, and the locking protrusion portion 54 of the positioning wall portion 52 is held and locked inside the locking recess portion 55.

Note that the positioning wall portion 52 has an outer shape larger than the through hole 53 inside the guide wall portion 51 when viewed from the extension direction of the center line CL1 of the socket terminal 20. This reliably seals a space between the guide wall portion 51 and the positioning wall portion 52 inside the guide wall portion 51.

According to the socket terminal 20, the lance portion 40 is provided at the other end portion 212 in the extension direction of the terminal body 21, so that when the socket terminal 20 is held in the holding portion 11 of the housing 10, the lance portion 40 is lastly held in the holding portion 11. This makes a sliding distance between the inner peripheral surface 13 of the holding portion 11 of the housing 10 and each of the positioning lances 41, 42 and 43 when the socket terminal 20 is held in the holding portion 11 short as compared with the contact pin disclosed in PTL 1 having a pair of lances provided on a body portion provided in a middle of the contact pin, thereby each of the positioning lances 41, 42 and 43 being locked to the locking portion 12 of the housing 10 at a position closer to the user. This in turn makes it possible to realize the socket terminal 20 that can be easily held in the holding portion 11 of the housing 10 and that allows confirmation of whether each of the positioning lances 41, 42 and 43 is locked to the locking portion 12 of the housing 10 to be easily made.

The socket terminal 20 has at least three positioning lances, that is, the first positioning lance 41, the second positioning lance 42, and the third positioning lance 43, that position the socket terminal 20 in the holding portion 11 of the connector 1 in the extension direction of the center line CL1. The angle θ1 formed by the first imaginary straight line L1 connecting the center line CL1 and the first positioning lance 41 and the second imaginary straight line L2 connecting the center line CL1 and the second positioning lance 42 is larger than 0 degrees and smaller than 180 degrees around the center line CL1 of the socket terminal 20, and the angle θ3 formed by the first imaginary straight line L1 and the third imaginary straight line L3 connecting the center line CL1 and the third positioning lance 43 is larger than 0 degrees and smaller than 180 degrees around the center line CL1 of the terminal body 21. This allows, as compared with the contact pin having a pair of lances arranged at intervals of 180 degrees or more around the center line disclosed in PTL 1, the socket terminal 20 to be easily locked to the locking portion 12 of the housing 10 regardless of the orientation of the socket terminal 20 around the center line CL1 when the socket terminal 20 is held in the holding portion 11. This in turn makes it possible to realize the socket terminal 20 that can reduce falling off of the socket terminal 20 from the housing 10.

The positioning lances 41, 42 and 43 are arranged at equal intervals in the circumferential direction on the circumference of the circle centered on the center line CL1 when viewed from the extension direction of the center line CL1. This in turn makes it possible to realize the socket terminal 20 that can more reliably reduce falling off from the housing 10.

The terminal body 21 has the electric wire guide surface 24 configured to guide the electric wire 2 in the extension direction of the center line CL1 when the conductor portion 5 of the electric wire 2 is connected to the connection portion 22. The electric wire guide surface 24 allows the electric wire 2 to smoothly move in the extension direction of the center line CL1, which in turn allows the conductor portion 5 of the electric wire 2 to be easily connected to the connection portion 22.

The terminal body 21 has the pair of electric wire clamp portions 23 capable of clamping the insulation portion 6 of the electric wire 2 when the conductor portion 5 of the wire 2 is connected to the connection portion 22. The pair of electric wire clamp portions 23 can reduce a load applied to the conductor portion 5 of the electric wire 2 when the conductor portion 5 is connected to the connection portion 22.

Since the connector 1 includes the socket terminal 20, it is possible to realize the connector 1 that prevents the socket terminal 20 from falling off of the socket terminal 20 from the housing 10 and that is easily assembled.

In the socket terminal 20, the resin positioning portion 50 has the guide wall portion 51 with a tubular shape having the through hole 53 extending along the center line CL1, and the positioning wall portion 52 formed by cutting and raising part of the terminal body 21 and configured to close the through hole 53 in the extension direction of the center line CL1 inside the guide wall portion 51. The positioning wall portion 52 has the locking protrusion portion 54 protruding from the positioning wall portion 52 toward the outside of the resin positioning portion 50, and the guide wall portion 51 has the locking recess portion 55 that locks the locking protrusion portion 54 to restrict the position of the positioning wall portion 52 relative to the guide wall portion 51. This allows the positioning wall portion 52 to prevent the resin-filled portion 60 from being formed in the contact portion 30 even when, for example, resin flows from a side adjacent to the lance portion 40 into the resin positioning portion 50 when molding the cover portion 3 of the resin, which in turn makes it possible to suppress a reduction in connectivity of the socket terminal 20 due to the resin.

The guide wall portion 51 has a cylinder shape having the through hole 53 with a columnar shape, the positioning wall portion 52 has a disk shape, and the locking protrusion portion 54 and the uncut portion 56 of the positioning wall portion 52 are arranged on opposite sides of the positioning wall portion 52 in the radial direction with respect to the center of the disk shape. This makes it possible to more reliably restrict the position of the positioning wall portion 52 relative to the guide wall portion 51.

Since the connector 1 includes the socket terminal 20, it is possible to realize the connector 1 that is high in connectivity.

In the socket terminal 20, the contact portion 30 has the position restriction portion 31 configured by the annular band portion 34 provided at the tip of the terminal body 21 adjacent to the one end portion 211 and extending in the circumferential direction on the inner peripheral surface 13 of the housing 10 constituting the holding portion 11. Since the position restriction portion 31 restricts the position of the contact portion 30 in the direction orthogonal to the extension direction of the holding portion 11 when the socket terminal 20 is held in the holding portion 11, it is possible to prevent the one end portion 211 of the terminal body 21 from ratting. This in turn makes it possible to increase contact reliability of the socket terminal 20 with respect to the plug terminal 120.

The bent portion 38 that is bent away from the center line CL1 in the width direction of the terminal body 21 is provided at the distal end portion 36 of the resilient contact portion 33 adjacent to the position restriction portion 31. This bent portion 38 allows, when the plug terminal 120 is inserted into the holding portion 11, the resilient contact portion 33 to resiliently deform with ease in the width direction of the terminal body 21 and in the direction away from the center line CL1.

The contact portion 30 has the pair of resilient contact portions 33 provided at the one end portion and the other end portion in the width direction of the terminal body 21 and arranged symmetrically with respect to the center line CL1. This allows the pair of resilient contact portions 33 to clamp the plug terminal 120 inserted into the holding portion 11, which in turn makes it possible to further increase the contact reliability of the socket terminal 20 with respect to the plug terminal 120.

The position restriction portion 31 is configured to restrict the position through contact between the outer peripheral surface of the annular band portion 34 and the inner peripheral surface 13 of the housing 10 when the position restriction portion 31 is held in the holding portion 11. This makes it possible to more reliably prevent the one end portion 211 of the terminal body 21 from ratting.

Since the connector 1 includes the socket terminal 20, it is possible to realize the connector 1 that is high in contact reliability.

Note that the locking portion of the housing 10 is not limited to the cutout portion 12 and may be capable of locking to the lance portion 40 of the socket terminal 20 in the extension direction of the center line CL1 of the socket terminal 20.

It is not limited to the configuration where the locking portion includes four cutout portions 12 each associated with a corresponding one of the holding portions 11, but the locking portion 12 may include, for example, two cutout portions 12 each associated with a corresponding one of two adjacent holding portions 11.

It is not limited to the configuration where the position restriction portion 31 of the contact portion 30 is provided at the tip of the terminal body 21 adjacent to the one end portion 211. The position restriction portion 31 may be provided at any position between the tip of the terminal body 21 adjacent to the one end portion 211 and the resin positioning portion 50.

It is not limited to the configuration where the annular band portion 34 of the position restriction portion 31 has an approximately uniform width W, but the annular band portion 34 may have a plurality of different widths. That is, the annular band portion 34 may have any shape as long as the annular band portion 34 can restrict, with its outer peripheral surface, the position of the contact portion 30 in the direction orthogonal to the extension direction of the holding portion 11.

The resilient contact portion 33 may come into contact with the plug terminal 120 inserted into the holding portion 11 to resiliently deform in the width direction of the terminal body 21 and away from the center line CL1. For example, the shape of the resilient contact portion 33 is not limited to a flat plate shape, but may be a plate shape curved along the annular band portion 34 of the position restriction portion 31, and the proximal end portion 37 may be connected to the resin positioning portion 50 rather than the terminal body 21.

Further, it is not limited to the configuration where the resilient contact portion 33 is provided as a pair on both sides in the width direction of the terminal body 21, but the resilient contact portion 33 may be provided at least at one end portion in the width direction of the terminal body 21.

Further, it is not limited to the configuration where the resilient contact portions 33 are arranged symmetrically with respect to the center line CL1, but the resilient contact portions 33 may be arranged asymmetrically with respect to the center line CL1.

According to the embodiment, the first positioning lance 41 is the first positioning lance, the second positioning lance 42 is the second positioning lance, and the third positioning lance 43 is the third positioning lance, but it is not limited to this configuration. For example, the first positioning lance 41 may be the second positioning lance, the second positioning lance 42 may be the third positioning lance, and the third positioning lance 43 may be the first positioning lance.

The lance portion 40 may have at least three positioning lances 41, 42 and 43. For example, the lance portion 40 may have fourth positioning lances in addition to the first to third positioning lances 41, 42 and 43.

The electric wire clamp portion 23, the electric wire guide surface 24, and the resin positioning portion 50 may be eliminated in accordance with the design of the socket terminal 20 or the like.

The guide wall portion 51 of the resin positioning portion 50 may have a tubular shape, and the shape is not limited to a cylinder shape.

The positioning wall portion 52 may be capable of closing the through hole 53 inside the guide wall portion 51. That is, the shape of the positioning wall portion 52 is not limited to a disk shape, but may be a different shape, and the positioning wall portion 52 may be provided at any position inside the guide wall portion 51 in the extension direction of the center line CL1 of the socket terminal 20.

Figure 11:
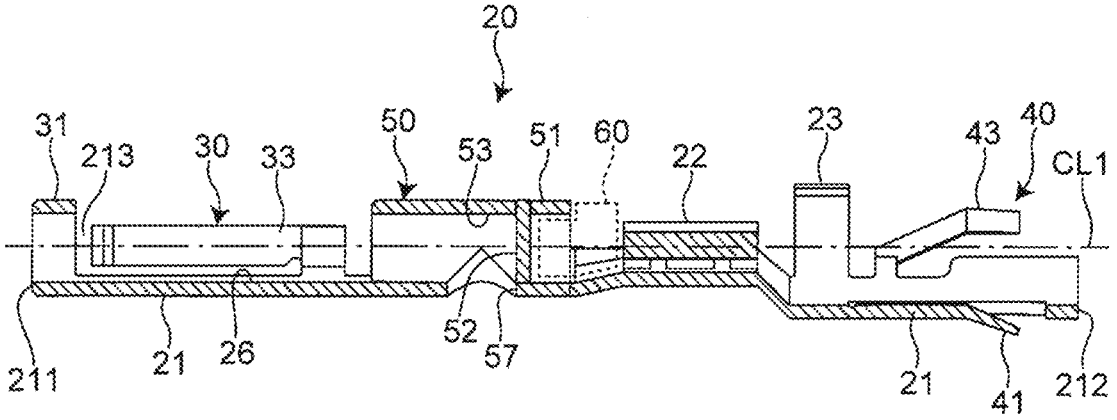
FIG. 11 is a cross-sectional view for describing a modification of the socket terminal shown in FIG. 4.

It is not limited to the configuration where the positioning wall portion 52 is formed by cutting and raising from a side adjacent to the lance portion 40 toward the contact portion 30, but as shown in FIG. 11, the positioning wall portion 52 may be formed by cutting and raising from a side adjacent to the contact portion 30 toward the lance portion 40. As described above, forming the positioning wall portion 52 by cutting and raising from a side adjacent to the contact portion 30 toward the lance portion 40 makes it possible to more reliably prevent the resin-filled portion 60 from being formed in the contact portion 30.

The locking protrusion portion 54 of the positioning wall portion 52 may be provided at the cut and raised portion of the positioning wall portion 52, and it is not limited to the configuration where the locking protrusion portion 54 and the uncut portion 56 of the positioning wall portion 52 are arranged on opposite sides of the positioning wall portion 52 in the radial direction from the center of the positioning wall portion 52.

It is not limited to the configuration where the positioning wall portion 52 is formed by cutting and raising part of the terminal body 21. If possible, the positioning wall portion 52 may be formed by cutting and raising part of the guide wall portion 51 or may be formed by cutting and raising part the terminal body 21 and part of the guide wall portion 51.

Figure 12:
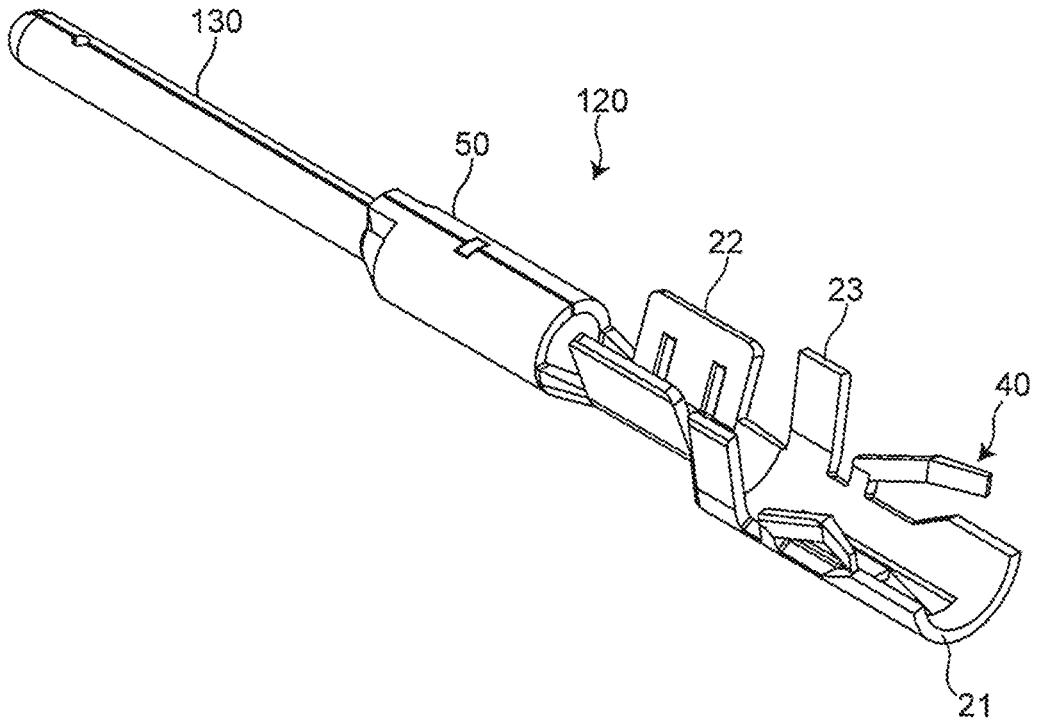
FIG. 12 is a perspective view of a plug terminal that is a connector terminal according to the embodiment of the present disclosure.

In the embodiment, the socket terminal 20 as an example of the connector terminal and the socket connector 1 including the socket terminal 20 have been described, but the present disclosure without the contact portion 30 is applicable to the plug terminal 120 shown in FIG. 12 and a plug connector including the plug terminal 120. That is, the plug terminal 120 is identical to the socket terminal 20 in configuration except for the contact portion 130 with an approximately cylinder shape extending along the center line CL1.

Although the various embodiments of the present disclosure have been described in detail with reference to the drawings, a description will be given in conclusion of various aspects of the present disclosure. Note that the following description will be given as an example with the reference numerals attached.

A connector terminal 20 according to a first aspect of the present disclosure that can be held in a holding portion 11 of a connector 1 having a housing 10, which has insulation properties and in which the holding portion 11 is provided, and that can connect an electric wire 2, the connector terminal 20 comprises:

a terminal body 21 extending along a center line CL1;

a contact portion 30 provided at a first end portion 211 of the terminal body 21 in an extension direction of the terminal body 21;

a lance portion 40 provided at a second end portion 212 of the terminal body 21 in the extension direction of the terminal body 21; and a connection portion 22 that is disposed between the contact portion 30 and the lance portion 40 and that can connect a conductor portion 5 of the electric wire 2 from the lance portion 40 side, wherein the lance portion 40 includes at least three positioning lances 41, 42 and 43, which are provided at intervals around the center line CL1, that can be locked to a locking portion 12 of the housing 10 in an extension direction of the center line CL1, and that position the connector terminal 20 in the holding portion 11 in the extension direction of the center line CL1, the at least three positioning lances 41, 42 and 43 include a first positioning lance 41, a second positioning lance 42 and a third positioning lance 43, the second positioning lance 42 and the third positioning lance 43 being arranged on both sides of the first positioning lance 41 in a circumferential direction with respect to the center line CL1, and when viewed from the extension direction of the center line CL1, an angle θ1 formed by a first imaginary straight line L1 connecting the center line CL1 and the first positioning lance 41 and a second imaginary straight line L2 connecting the center line CL1 and the second positioning lance 42 is larger than 0 degrees and smaller than 180 degrees around the center line CL1, and an angle θ3 formed by the first imaginary straight line L1 and a third imaginary straight line L3 connecting the center line CL1 and the third positioning lance 43 is larger than 0 degrees and smaller than 180 degrees around the center line CL1.

In the connector terminal 20 according to the first aspect, the lance portion 40 is provided at the other end portion 212 in the extension direction of the terminal body 21. This makes a sliding distance between the inner peripheral surface 13 of the holding portion 11 of the housing 10 and each of the positioning lances 41, 42 and 43 when the connector terminal 20 is held in the holding portion 11 short as compared with the contact pin having a pair of lances provided on a body portion provided in a middle of the contact pin disclosed in PTL 1, thereby causing each of the positioning lances 41, 42 and 43 to be locked to the locking portion 12 of the housing 10 at a position closer to the user. This in turn makes it possible to realize the connector terminal 20 that can be easily held in the holding portion 11 of the housing 10 and that allows confirmation of whether each of the positioning lances 41, 42 and 43 is locked to the locking portion 12 of the housing 10 to be easily made.

Further, in the connector terminal 20 according to the first aspect, the angle θ1 formed by the first imaginary straight line L1 and the second imaginary straight line L2 is larger than 0 degrees and smaller than 180 degrees around the center line CL1 of the connector terminal 20, and the angle θ3 formed by the first imaginary straight line L1 and the third imaginary straight line L3 is larger than 0 degrees and smaller than 180 degrees around the center line CL1 of the terminal body 21. This allows, as compared with the contact pin having a pair of lances arranged at intervals of 180 degrees or more around the center line disclosed in PTL 1, the connector terminal 20 to be easily locked to the locking portion 12 of the housing 10 regardless of an orientation of the connector terminal 20 around the center line CL1 when the connector terminal 20 is held in the holding portion 11. This in turn makes it possible to realize the connector terminal 20 that can reduce falling off from the housing 10.

In the connector terminal 20 according to a second aspect the present disclosure, wherein the first positioning lance 41, the second positioning lance 42, and the third positioning lance 43 are arranged at equal intervals in the circumferential direction on a circumference of a circle centered on the center line CL1 when viewed from the extension direction of the center line CL1.

With the connector terminal 20 according to the second aspect, it is possible to realize the connector terminal 20 that can more reliably reduce falling off of the connector terminal 20 from the housing 10.

In the connector terminal 20 according to a third aspect of the present disclosure, wherein the terminal body 21 includes an electric wire guide surface 24 provided at the other end portion 212 of the terminal body 21 to guide movement of the electric wire 2 in the extension direction of the center line CL1 when the conductor portion 5 of the electric wire 2 is connected to the connection portion 22, and the first positioning lance 41 is disposed on the electric wire guide surface 24.

With the connector terminal 20 according to the third aspect, the electric wire guide surface 24 allows the electric wire 2 to smoothly move in the extension direction of the center line CL1, which in turn allows the conductor portion 5 of the electric wire 2 to be easily connected to the connection portion 22.

In the connector terminal 20 according to a fourth aspect of the present disclosure, wherein the terminal body 21 includes a pair of electric wire clamp portions 23 that are provided between the connection portion 22 and the other end portion 212 of the terminal body 21, that extend around the center line CL1 from the first and the second end portions of the terminal body 21 in a width direction intersecting the extension direction of the center line CL1, and that can clamp the insulation portion 6 of the electric wire 2 when the conductor portion 5 of the electric wire 2 is connected to the connection portion 22.

With the connector terminal 20 according to the fourth aspect, the pair of electric wire clamp portions 23 can reduce a load applied to the conductor portion 5 of the electric wire 2 when the conductor portion 5 is connected to the connection portion 22.

A connector 1 according to a fifth aspect of the present disclosure comprises:

the connector terminal 20; and the housing 10 including the holding portion 11 in which the connector terminal 20 is held.

With the connector 1 according to the fifth aspect, since the connector 1 includes the connector terminal 20, it is possible to realize the connector 1 that makes the connector terminal 20 less prone to fall off from the housing 10 and that is easily assembled.

Note that suitably combining any of the various embodiments or any of the various modifications makes it possible to achieve effects possessed by each of the embodiments or the modifications. Further, combinations of the embodiments, combinations of the modifications, or combinations of the embodiments and the modifications are possible, and combinations of features in different embodiments or modifications are also possible.

While the present disclosure has been fully described in connection with the preferred embodiments with reference to the accompanying drawings, it will be apparent to those skilled in the art that various changes and modifications may be made. Unless such changes and modifications depart from the scope of the present disclosure as set forth in the accompanying claims, the changes and modifications should be construed as being included within the scope of the present disclosure.

INDUSTRIAL APPLICABILITY

The connector terminal according to the present disclosure is applicable to, for example, a machine tool for automobile.

Further, the connector according to the present disclosure is applicable to, for example, a machine tool for automobile.

REFERENCE SIGNS LIST

1. connector
2. electric wire
3. cover portion
4. fixing portion
5. conductor portion
6. insulation portion
10. housing
101. outer end portion
102. inner end portion
103. opening portion
11. holding portion
12. cutout portion (an example of locking portion)
13. inner peripheral surface
20. socket terminal (an example of connector terminal)
21. terminal body
211. first end portion (one end portion)
212. second end portion (other end portion)
213. plug terminal holding portion
22. connection portion
23. electric wire clamp portion
24. electric wire guide surface
26. terminal guide surface
30, 130. contact portion
31. position restriction portion
33. resilient contact portion
34. annular band portion
36. distal end portion
37. proximal end portion
38. bent portion
40. lance portion
41. first positioning lance
411. bent portion
42. second positioning lance
421. bent portion
43. third positioning lance
431. bent portion
50. resin positioning portion
51. guide wall portion
52. positioning wall portion
53. through hole
54. locking protrusion portion
55. locking recess portion
56. uncut portion
57. through hole
60. resin-filled portion
120. plug terminal
201. first member
202. second member
203. third member
204, 205. outer side surface
551, 552. recess portion
CL1 to CL3. center line
W. width
L1 to L5, L11, L12, L21, L22, L31, L32. imaginary straight line
D1, D2. thickness direction
θ1 to θ3. angle
CP. center point

The invention claimed is:

1. A connector terminal that can be held in a holding portion of a connector having a housing, which has insulation properties and in which the holding portion is provided, and that can connect an electric wire, the connector terminal comprising:

a terminal body extending along a center line;

a contact portion provided at a first end portion of the terminal body in an extension direction of the terminal body;

a lance portion provided at a second end portion of the terminal body in the extension direction of the terminal body; and a connection portion that is disposed between the contact portion and the lance portion and that can connect a conductor portion of the electric wire from the lance portion side, wherein the lance portion includes at least three positioning lances, which are provided at intervals around the center line, that can be locked to a locking portion of the housing in an extension direction of the center line, and that position the connector terminal in the holding portion in the extension direction of the center line, the at least three positioning lances include a first positioning lance, a second positioning lance and a third positioning lance, the second positioning lance and the third positioning lance being arranged on both sides of the first positioning lance in a circumferential direction with respect to the center line, when viewed from the extension direction of the center line, an angle formed by a first imaginary straight line connecting the center line and the first positioning lance and a second imaginary straight line connecting the center line and the second positioning lance is larger than 0 degrees and smaller than 180 degrees around the center line, and an angle formed by the first imaginary straight line and a third imaginary straight line connecting the center line and the third positioning lance is larger than 0 degrees and smaller than 180 degrees around the center line, and each of the first positioning lance, the second positioning lance and the third positioning lance includes a bend portion located closer to the center line than an forth imaginary straight line extending along a center line and connecting both end portions in an extension direction of each of the first positioning lance, the second positioning lance and the third positioning lance.

2. The connector terminal according to claim 1, wherein the first positioning lance, the second positioning lance, and the third positioning lance are arranged at equal intervals in the circumferential direction on a circumference of a circle centered on the center line when viewed from the extension direction of the center line.

3. The connector terminal according to claim 1, wherein the terminal body includes an electric wire guide surface provided at the second end portion of the terminal body to guide movement of the electric wire in the extension direction of the center line when the conductor portion of the electric wire is connected to the connection portion, and the first positioning lance is disposed on the electric wire guide surface.

4. The connector terminal according to claim 1, wherein the terminal body includes a pair of electric wire clamp portions that are provided between the connection portion and the second end portion of the terminal body, that extend around the center line from the first and the second end portions of the terminal body in a width direction intersecting the extension direction of the center line, and that can clamp the insulation portion of the electric wire when the conductor portion of the electric wire is connected to the connection portion.

5. A connector comprising:

the connector terminal according to claim 1; and the housing including the holding portion in which the connector terminal is held.

6. The connector terminal according to claim 2, wherein the terminal body includes an electric wire guide surface provided at the second end portion of the terminal body to guide movement of the electric wire in the extension direction of the center line when the conductor portion of the electric wire is connected to the connection portion, and the first positioning lance is disposed on the electric wire guide surface.

7. The connector terminal according to claim 2, wherein the terminal body includes a pair of electric wire clamp portions that are provided between the connection portion and the second end portion of the terminal body, that extend around the center line from the first and the second end portions of the terminal body in a width direction intersecting the extension direction of the center line, and that can clamp the insulation portion of the electric wire when the conductor portion of the electric wire is connected to the connection portion.

8. A connector comprising:

the connector terminal according to claim 2; and the housing including the holding portion in which the connector terminal is held.

9. A connector comprising:

the connector terminal according to claim 3; and the housing including the holding portion in which the connector terminal is held.

10. A connector comprising:

the connector terminal according to claim 4; and the housing including the holding portion in which the connector terminal is held.

* * * * *